US008534191B2

(12) United States Patent
Heiler et al.

(10) Patent No.: US 8,534,191 B2
(45) Date of Patent: Sep. 17, 2013

(54) PRINTING PRESS AND METHOD FOR OPERATING A PRINTING UNIT OF A PRINTING PRESS

(75) Inventors: Peter Heiler, Forst (DE); Jens Hieronymus, Darmstadt (DE); Burkhard Maass, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 694 days.

(21) Appl. No.: 12/245,018

(22) Filed: Oct. 3, 2008

(65) Prior Publication Data

US 2009/0101036 A1 Apr. 23, 2009

(30) Foreign Application Priority Data

Oct. 18, 2007 (DE) ..... 10 2007 049 916

(51) Int. Cl.
*B41F 7/02* (2006.01)
*B41F 13/24* (2006.01)
*B41F 13/00* (2006.01)

(52) U.S. Cl.
USPC ... 101/218; 101/247; 101/351.1; 101/352.06; 101/350.3

(58) Field of Classification Search
USPC ..... 101/350.3, 352.06, DIG. 38, 352.01, 101/351.1, 247, 218
See application file for complete search history.

(56) References Cited

U.S. PATENT DOCUMENTS 5,025,726 A * 6/1991 Funabashi et al. ..... 101/352.05
5,134,939 A 8/1992 Borne
6,349,643 B1 * 2/2002 Loftus et al. ..... 101/351.1
6,539,858 B2 4/2003 Aoyama et al.
6,546,865 B2 * 4/2003 Fischer et al. ..... 101/350.3
6,578,481 B1 * 6/2003 Beisel et al. ..... 101/350.3
6,634,292 B2 10/2003 Fujiwara et al.
6,698,352 B2 * 3/2004 Fujiwara et al. ..... 101/349.1
7,104,197 B2 9/2006 Kusaka et al.
7,114,439 B2 * 10/2006 Gerner et al. ..... 101/217
7,296,516 B2 11/2007 Herbert et al.
7,392,740 B2 * 7/2008 Baintner et al. ..... 101/177

FOREIGN PATENT DOCUMENTS

DE 26 04 623 A1 8/1977
DE 101 63 961 A1 7/2003
DE 10304296 A1 8/2004
DE 10 2006 032 231 A1 2/2007

(Continued)

OTHER PUBLICATIONS

German Patent and Trademark Office Search Report, dated Feb. 22, 2008.

*Primary Examiner* — Ren Yan
*Assistant Examiner* — Leo T Hinze
(74) *Attorney, Agent, or Firm* — Laurence A. Greenberg; Werner H. Stemer; Ralph E. Locher

(57) ABSTRACT

A method for operating a printing unit of a printing press includes operating the printing unit in a first operating mode, for example printing operation, and in a second operating mode, for example maintenance operation. In the first operating mode, a printing unit cylinder and a distributor roller are driven rotationally by a first motor and the distributor roller is driven axially by a second motor. In the second operating mode, the distributor roller is driven rotationally by a third motor and the distributor roller is driven axially by the second motor. A printing press for carrying out the method is also provided.

7 Claims, 1 Drawing Sheet

(56) References Cited

FOREIGN PATENT DOCUMENTS

| | | | |
|---|---|---|---|
| EP | 1 167 026 | B1 | 1/2002 |
| EP | 1167026 | B1 | 5/2006 |
| JP | 63315244 | A | 12/1988 |
| JP | 1208137 | A | 8/1989 |
| JP | 4224957 | A | 8/1992 |
| JP | 05005452 | U | 1/1993 |
| JP | 2001225452 | A | 8/2001 |
| JP | 2002166525 | A | 6/2002 |
| JP | 2002178482 | A | 6/2002 |
| JP | 2004058331 | A | 2/2004 |
| JP | 2004202788 | A | 7/2004 |
| JP | 2005040991 | A | 2/2005 |

* cited by examiner

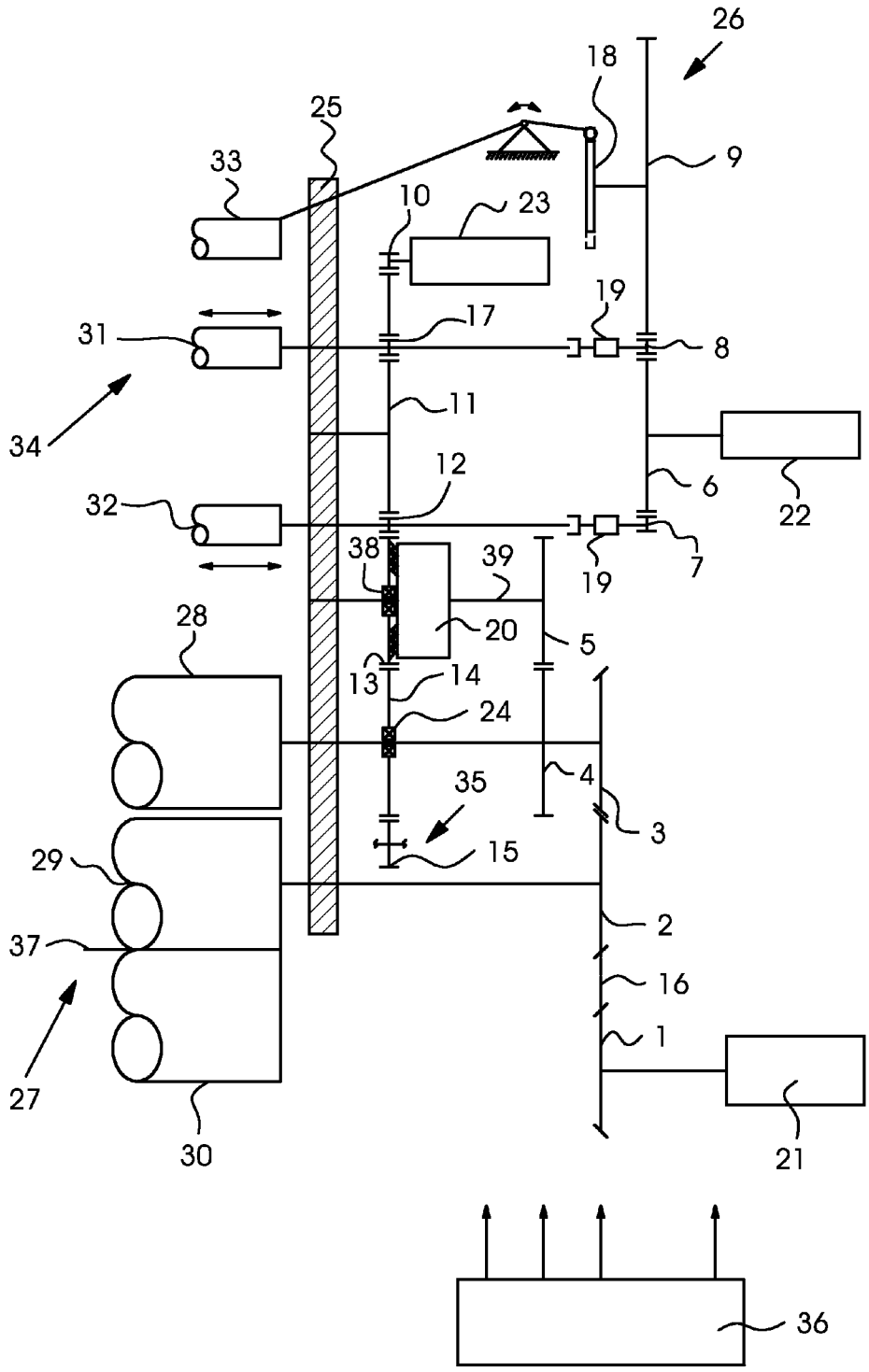
26
18
25
9
33
10
23
19
31
17
8
34
11
12
6
22
32
38
39
19
7
28
20
5
13
14
24
4
35
3
29
15
2
37
16
1
27
30
21
36

PRINTING PRESS AND METHOD FOR OPERATING A PRINTING UNIT OF A PRINTING PRESS

CROSS-REFERENCE TO RELATED APPLICATION

This application claims the priority, under 35 U.S.C. §119, of German Patent Application DE 10 2007 049 916.9, filed Oct. 18, 2007; the prior application is herewith incorporated by reference in its entirety.

BACKGROUND OF THE INVENTION

Field of the Invention

The present invention relates to a method for operating a printing unit of a printing press in which, in a first operating mode, a printing unit cylinder and a distributor roller are driven rotationally by a first motor and the distributor roller is driven axially by a second motor and, in a second operating mode, the distributor roller is driven axially by the second motor. The present invention also relates to a printing press suitable for implementing this method.

In European Patent EP 1 167 026 B1, corresponding to U.S. Pat. No. 6,634,292, a printing press is described in which in a first operating mode a printing unit cylinder and a distributor roller are driven rotationally by a first motor and the distributor roller is driven axially by a second motor, and in a second operating mode the printing unit cylinder is driven rotationally by the first motor and the distributor roller is driven axially by the second motor. In the case of that prior art printing press, the distributor roller is driven rotationally by the second motor in the second operating mode. Two controllable clutches are required, which are comparatively expensive, in order to implement the two operating modes.

SUMMARY OF THE INVENTION

It is accordingly an object of the invention to provide a printing press and a method for operating a printing unit of a printing press, which overcome the hereinafore-mentioned disadvantages of the heretofore-known devices and methods of this general type and which can be implemented less expensively.

With the foregoing and other objects in view there is provided, in accordance with the invention, a method for operating a printing unit of a printing press. The method comprises, in a first operating mode, rotationally driving a printing unit cylinder and a distributor roller with a first motor and axially driving the distributor roller with a second motor and, in a second operating mode, axially driving the distributor roller with the second motor and rotationally driving the distributor roller with a third motor.

With the objects of the invention in view, there is also provided a printing press, comprising a printing unit including a printing unit cylinder, a distributor roller, a first motor for rotationally driving the printing unit cylinder and the distributor roller in a first operating mode, a second motor for axially driving the distributor roller in the first operating mode and in the second operating mode, and a third motor for rotationally driving the distributor roller in the second operating mode.

One advantage of the invention is to be seen in the fact that the second clutch that is present in the prior art described at the outset is replaced by the third motor. It has turned out that electric motors which can be obtained on the market and which can be used as the third motor are less expensive than controllable clutches that are on the market.

In accordance with another mode of the invention, the first motor and the distributor roller have a clutch interposed which is kept engaged in the first operating mode and is kept disengaged in the second operating mode. This clutch can be the single clutch that is present for rotational driving of the inking unit of the printing unit. A further clutch provided for this purpose, which is present in the described prior art, is not required.

In accordance with a further mode of the invention, in the first operating mode the third motor is driven rotationally by the first motor. In this case, provision can be made in the first operating mode for the third motor to co-rotate without power in so-called generator operation. Instead, provision can also be made in the first operating mode for the third motor to be supplied with power in such a way that the third motor brakes the first motor. Through the use of the two variants, it is possible to achieve mutual preloading of gear wheels which are disposed between the first motor and the third motor. Through the use of this preloading of the gear wheels, their tooth flank or side contact is ensured, which is advantageous with regard to high printing quality. Likewise, it is possible to drive the third motor in such a way that in the first operating mode the third motor compensates for or at least minimizes rotational fluctuations caused by the first motor or the gear mechanism.

In accordance with an added mode of the invention, the first operating mode is the printing operation and the second operating mode is a maintenance operation. This maintenance operation can, for example, be a cleaning operation for washing the inking unit.

In accordance with an additional mode of the invention, in the second operating mode the printing unit cylinder is driven rotationally by the first motor. This can be provided for the case in which the inking unit and the printing unit cylinder are to be cleaned simultaneously in the second operating mode. Instead of this, however, provision can also be made for the first motor and the printing unit cylinder to remain stationary in the second operating mode while only the inking unit driven rotationally by the third motor is being cleaned.

In accordance with yet another mode of the invention, the printing unit cylinder is either an impression cylinder or a printing form cylinder. Likewise, provision can be made for an impression cylinder of the printing unit and a printing form cylinder of the printing unit to be connected to each other through a gear mechanism and to the first motor in such a way that both the impression cylinder and the printing form cylinder are driven rotationally by the first motor in both operating modes or at least in the first operating mode. If the printing press includes a plurality of printing units constructed in the manner described previously, the first motor can be a so-called main drive of the printing press, which drives all of the printing units in the manner described previously. This main drive of the printing press can be connected in parallel with a further main drive of the printing press, so that the printing unit cylinders, that is to say impression cylinders and printing form cylinders and, if appropriate, blanket cylinders, of the printing units are driven rotationally by a plurality of parallel-connected main drives in the two operating modes or at least in the first operating mode. According to another possible variant, the impression cylinders of the printing units are driven rotationally by the single main drive or the parallel-connected main drives, and the printing form cylinder of the respective printing unit is assigned a separate drive, which forms the first motor that drives the printing form cylinder and the distributor roller rotationally in the first operating mode and drives the printing form cylinder rotationally but not the distributor roller in the second operating mode.

The printing press according to the invention is preferably a sheetfed printing press, in which sheet printing material is printed in the first operating mode. The printing press is preferably a sheetfed rotary printing press for lithographic offset printing.

Other features which are considered as characteristic for the invention are set forth in the appended claims.

Although the invention is illustrated and described herein as embodied in a printing press and a method for operating a printing unit of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE VIEW OF THE DRAWING

The FIGURE of the drawing is a schematic and block diagram of a preferred exemplary embodiment of a printing press containing further structurally and functionally advantageous developments for implementing the method according to the invention.

DETAILED DESCRIPTION OF THE INVENTION

Referring now in detail to the single FIGURE of the drawing, there is seen a portion of a printing press 26. A printing unit 27 for printing sheets 37 is illustrated in the drawing. The printing unit 27 includes a printing form cylinder 28 as a printing unit cylinder, a blanket cylinder 29 and an impression cylinder 30. Furthermore, the printing unit 27 includes an inking unit 34 for inking the printing form cylinder 28, and a dampening unit 35. The dampening unit 35 includes a gearbox element which is illustrated in the drawing and dampening unit rollers which are not illustrated.

The inking unit 34 includes a ductor roller 33, a first distributor roller 31 and a second distributor roller 32. An ink fountain roller having an ink fountain, further distributor rollers, transfer rollers and ink applicator rollers are likewise constituent parts of the inking unit 34 but are also not illustrated in the drawing for reasons of better clarity. During printing operation, the ductor roller 33 swings back and forth between the aforementioned ink fountain roller and the first distributor roller 31, so that the ductor roller 33 alternately comes into contact with the ink fountain roller and the first distributor roller 31, in order to transfer the printing ink from the former to the latter. In order to implement this swinging movement, the ductor roller 33 is mounted in a lever, which is only symbolically illustrated in the drawing. The swinging movement of this lever is driven by a cam mechanism, which includes a radial control cam 18 and a cam roller fixed to the lever and running on the control cam 18.

A first motor 21 is connected to a first gear wheel 1, which has a drive connection through an intermediate gear mechanism 16 to a second gear wheel 2. The first motor 21 is an electric motor and is the main drive of the printing press 26. The second gear wheel 2, which is disposed coaxially with the blanket cylinder 29 and is firmly connected so as to rotate with the latter, meshes with a third gear wheel 3 which is disposed coaxially with the printing form cylinder 28 and is firmly connected so as to rotate with the latter. A fourth gear wheel 4, which meshes with a fifth gear wheel 5, is fixedly seated on a shaft which connects the third gear wheel 3 to the printing form cylinder 28 firmly so as to rotate with the latter.

A second motor 22 is connected to a sixth gear wheel 6, which meshes with a seventh gear wheel 7 and an eighth gear wheel 8, that is to say it is in mutual tooth engagement therewith. The second motor 22 is an electric motor and is an additional drive, which is used to drive the axial oscillating movement of the distributor rollers and to drive the swinging movement of the ductor roller 33. The seventh gear wheel 7 has a drive connection to the second distributor roller 32 through an oscillating gear mechanism 19. The eighth gear wheel 8 is connected to the first distributor roller 31 by just such an oscillating gear mechanism 19. The oscillating gear mechanisms 19 convert the rotational movements of the gear wheels 7, 8 into axial oscillating movements of the distributor rollers 31, 33 and are only symbolically indicated in the drawing. The eighth gear wheel 8 meshes with a ninth gear wheel 9, which is disposed coaxially with the control cam 18 and firmly connected so as to rotate with the latter. The second motor 22 drives the rotation of the control cam 18 and thus the swinging ductor movement of the ductor roller 33 through the gear train including the gear wheels 6, 8, 9.

A third motor 23 is connected to a tenth gear wheel 10, which has a drive connection to an eleventh gear wheel 11 through an intermediate gear mechanism 17 indicated symbolically in the drawing. The third motor 23 is an electric motor and is used to drive the rotation of the distributor rollers 31, 32 and a distributor roller of the dampening unit 35, which is not illustrated in the drawing. The intermediate gear mechanism 17, like the intermediate gear mechanism 16, is a gear train. The intermediate gear mechanism 17 includes a gear wheel which is disposed coaxially with the first distributor roller 31 and is firmly connected so as to rotate with the latter. The eleventh gear wheel 11 meshes with a twelfth gear wheel 12, which is disposed coaxially with the second distributor roller 32 and firmly connected so as to rotate with the latter. The twelfth gear wheel 12 is seated fixedly on a shaft of the second distributor roller 32 and meshes with a thirteenth gear wheel 13, which in turn meshes with a fourteenth gear wheel 14. The fourteenth gear wheel 14 is disposed coaxially with the printing form cylinder 28 and, through a rotary bearing 24, is rotatably mounted on that shaft on which the third gear wheel 3 and the fourth gear wheel 4 are fixedly seated. The fourteenth gear wheel 14 meshes with a fifteenth gear wheel 15, which is a constituent part of a gear mechanism of the dampening unit 35. The thirteenth gear wheel 13 is rotatably mounted, through a rotary bearing 38, on a shaft 39 on which the fifth gear wheel 5 is fixedly seated.

The thirteenth gear wheel 13 can be connected firmly as required to the shaft 39 and thus to the fifth gear wheel 5 so as to rotate with them, through the use of a clutch 20 disposed between the fifth gear wheel 5 and the thirteenth gear wheel 13. When the clutch 20 is engaged, the thirteenth gear wheel 13 is firmly connected to the shaft 39 and the fifth gear wheel 5 so as to rotate with them and, when the clutch 20 is released, the thirteenth gear wheel 13 is not firmly connected to the shaft 39 and the fifth gear wheel 5 so as to rotate with them. When the clutch 20 is disengaged, the thirteenth gear wheel 13 can rotate freely on the shaft 39. The above-described cylinders, rollers and gear wheels and their shafts are rotatably mounted in a side wall 25 of a machine frame.

In addition, the printing press 26 includes an electronic control device 36, which drives the motors 21, 22, 23 and the clutch 20 appropriately in operating modes explained below. The printing press 26 is operated as follows:

In a first operating mode, which is printing operation, the first motor 21 drives the rotations of the printing form cylinder 28 and of the blanket cylinder 29 through the gear wheels 1, 2, 3. At the same time, the first motor 21 additionally drives the rotation of the impression cylinder 30 through a gear wheel belonging to the intermediate gear mechanism 16.

In the first operating mode, the clutch 20 is engaged, so that the clutch 20 transmits the drive output of the first motor 21 from the fifth gear wheel 5 to the thirteenth gear wheel 13. The drive output of the first motor 21 is transmitted from the thirteenth gear wheel 13 to the twelfth gear wheel 12, which is disposed coaxially with the second distributor roller 32 and firmly connected so as to rotate with the latter. The drive output is transmitted from the twelfth gear wheel 12 through the eleventh gear wheel 11 to the gear wheel already mentioned, which is disposed coaxially with the first distributor roller 31 and firmly connected so as to rotate with the latter. This last-mentioned gear wheel is a constituent part of the intermediate gear mechanism 17 and is fixedly seated on the shaft of the first distributor roller 31. The drive output of the first motor 21 is transmitted from the intermediate gear mechanism 17 to the third motor 23 through the tenth gear wheel 10.

In the first operating mode, the third motor 23 can be driven by the control device 36 in such a way that the supply of electric power to the third motor 23 is prevented and the latter co-rotates with the tenth gear wheel 10 without power in a passive idle. According to another variant, in the first operating mode, the third motor 23 is supplied with electric power in such a way that, in this variant, in exactly the same way as in the passive idle variant mentioned previously, the first motor 21 dominates the third motor 23 or drives it rotationally in the first operating mode.

In the first operating mode, the second motor 22 drives the axial back and forth movement of the distributor rollers 31, 32 through the gear wheels 6, 7, 8 and the oscillating gear mechanism 19. In this case, the control device 36 regulates the rotational speed of the second motor 22 in such a way that the distributor rollers 31, 32 execute a complete axial swing in each case within two complete revolutions of the printing form cylinder 28. The operating personnel can continuously adjust a so-called distribution starting point of the distributor rollers 31, 32 on the control device 36. During this adjustment, the rotational angle position of the second motor 22 relative to the rotational angle position of the first motor 21 is changed, so that the phase angle of the dead point of the axial swing of the distributor rollers 31, 32 relative to the rotational angle position of the printing form cylinder 28 is changed. In the first operating mode, in addition the ductor movement of the ductor roller 33 is driven by the second motor 22, with the ductor roller 33 executing a complete swing in each case within three full revolutions of the printing form cylinder 28. The ductor roller 33 is thus ⅓ turn, while the distributor rollers 31, 32 are ½ turn.

In a second operating mode, which is maintenance operation, the inking unit 34 and the dampening unit 35 are washed by a cleaning apparatus, which is not illustrated in the drawing and which belongs to the printing unit 27. In the second operating mode, the axial oscillating movement of the distributor rollers 31, 32 is driven by the second motor 22 in the same way as in the first operating mode. In the second operating mode, the clutch 20 is disengaged, so that the thirteenth gear wheel 13 is no longer firmly connected to the shaft 39 and the fifth gear wheel 5 so as to rotate with them. When the clutch 20 is disengaged, the thirteenth gear wheel 13 is able to rotate around the shaft 39 and relative to the fifth gear wheel. Thus, in the second operating mode, no drive output or rotational movement can be transmitted from the first motor 21 to the distributor rollers 31, 32 and the third motor 23.

In the second operating mode, the rotation of the distributor rollers 31, 32 is driven by the third motor 23, with the drive output of the third motor 23 being transmitted through the tenth gear wheel 10 and the intermediate gear mechanism 17 to the shaft of the first distributor roller 31, and being transmitted from the intermediate gear mechanism 17 through the eleventh gear wheel 11 and the twelfth gear wheel 12 to the shaft of the second distributor roller 32. In the second operating mode, the first motor 21 can remain stationary or the rotational movement of the printing unit cylinders 28, 29, 30 or one of these cylinders can be driven by the first motor 21. For example, the ratio of the rotational speed of the distributor rollers 31, 32 relative to the rotational speed of the printing unit cylinders 28 to 39 can be different than in the first operating mode.

The invention claimed is:

1. A method for operating a printing unit of a printing press, the method comprising the following steps:

in a first operating mode, rotationally driving a printing unit cylinder and a distributor roller with a first motor and axially driving the distributor roller with a second motor;

in the first operating mode, driving an oscillating lifting movement of a ductor roller with the second motor;

in a second operating mode, axially driving the distributor roller with the second motor and rotationally driving the distributor roller with a third motor; and in the first operating mode, rotationally driving the third motor with the first motor and supplying the third motor with power for braking the first motor with the third motor.

2. The method according to claim 1, which further comprises providing a clutch between the first motor and the distributor roller, engaging the clutch in the first operating mode, and disengaging the clutch in the second operating mode.

3. The method according to claim 1, wherein the first operating mode is printing operation and the second operating mode is maintenance operation.

4. The method according to claim 1, wherein the printing unit cylinder is an impression cylinder.

5. The method according to claim 1, wherein the printing unit cylinder is a printing form cylinder.

6. The method according to claim 1, which further comprises printing sheets in the first operating mode.

7. The method according to claim 1, which further comprises rotationally driving the printing unit cylinder with the first motor in the second operating mode.

* * * * *